US005645187A

United States Patent [19]

Brown

[11] Patent Number: 5,645,187

[45] Date of Patent: Jul. 8, 1997

[54] SELF-EJECTING GARBAGE RECEPTACLE

[76] Inventor: Rita Corlette Brown, 2120 First Ave., #252, New York, N.Y. 10029

[21] Appl. No.: 247,244

[22] Filed: May 23, 1994

Related U.S. Application Data

[63] Continuation-in-part of Ser. No. 923,387, Aug. 3, 1992, Pat. No. 5,316,170.

[51] Int. Cl.[6] ..... B65D 42/26

[52] U.S. Cl. ..... 220/409; 414/417; 220/404; 220/908; 221/258

[58] Field of Search ..... 294/27.1; 414/417; 221/64, 260, 258; 220/409, 408, 403, 404, 908, 756, 754, 757, 762, 764, 765, DIG. 25

[56] References Cited

U.S. PATENT DOCUMENTS 3,002,602 10/1961 Giepen ..... 221/258

FOREIGN PATENT DOCUMENTS 2357758 5/1975 Germany ..... 221/64

*Primary Examiner*—Stephen J. Castellano

*Attorney, Agent, or Firm*—Cobrin Gittes & Samuel

[57] ABSTRACT

A self-ejecting garbage receptacle includes a container body for holding a garbage bag containing refuse, the container body having a bottom and a side wall enclosure with an open upper end, the side wall enclosure being connected with the bottom; a belt draped in the container body for normally supporting the bag in a lowered position in the container body, the belt having first and second opposite ends, with the first end being fixed to the side wall enclosure adjacent the open upper end; and a jug handle-shaped ejector handle for raising the belt, the ejector handle being connected with the second opposite end of the belt and being pivotally connected at one end thereof to an external surface of the container body; a hinge for pivotally connecting the ejector handle to the container body; a hook on an external surface of the container body; and a latch on the ejector handle for engaging with the hook to hold the belt in a raised position.

9 Claims, 7 Drawing Sheets

SELF-EJECTING GARBAGE RECEPTACLE

CLAIM OF PRIORITY

This is a continuation in part of application Ser. No. 07/923,387 filed Aug. 3, 1992 now U.S. Pat. No. 5,316,170.

BACKGROUND OF THE INVENTION

The present invention relates generally to garbage receptacles.

Waste containers for household use, and particularly those used in kitchen areas which include a foot-operated lid opening mechanism, are well known. Other kitchen-type containers that include a two-position lid are also known. Such waste containers have been immensely helpful in households.

However, it is still necessary to exert significant force to remove a garbage bag from the waste container, especially in the case where the garbage bag is heavy. A particular problem thus results if the user, such as a child or elderly person, has insufficient strength to remove the garbage bag from the waste container.

U.S. Pat. No. 2,980,287 to Fisher discloses a lock-down floating platform mechanism for spooler troughs and doff trucks in which a spring biased platform may be latched in place by a latching mechanism so that the same can be locked in a lowered position for purposes of loading or the like. Once loaded, the platform will float depending on the load, so that unloading from a convenient level always takes place. Thus, when the platform is full, it will remain in the lowered position, and as each level of bobbins or the like are removed, the next level will rise to the top for convenient unloading.

U.S. Pat. No. 3,612,457 to Morikawa et al discloses a device for supporting a sliver can or sliver plate on a platform. The platform is positioned in a raised position to receive slivers from the processing apparatus such that the same are supported as they are coiled within the sliver can. As the load is increased, the bias on the spring beneath the platform is slowly overcome until it is in a full downward, depressed position, allowing a full sliver coil to be loaded therein. In order to move the same from place to place, a latching mechanism associated with a stop rod and projection is provided to latch the sliver plate in place.

U.S. Pat. No. 3,489,473 to Goodwin, Jr. et al discloses a textile roving can in which the top of the container takes the form of a platform which is urged upward by a coil spring. The top moves downward under the weight of sliver or roving material as the material is deposited in the can. See also U.S. Pat. No. 4,261,079 to Masini et al.

U.S. Pat. No. 2,695,209 to de Witt et al discloses a can unpacker in which the container is designed to load bags of empty cans for processing, and particularly, one level of cans at a time is unloaded. A hand crank interfaces with a chain drive to allow each successive layer of cans to be moved upwards for placement on a conveyer.

U.S. Pat. No. 2,449,892 to Gibbs discloses a similar arrangement. Specifically, the container stores articles such as trays or plates so that one level of articles is always at the top for quick removal. The platform is automatically raised to continue this process until the container is empty.

U.S. Pat. No. 3,494,503 to Kingsley discloses a storage bin in which the level of a wheeled bin for books or other articles floats so that the same may be conveniently loaded from the top until fully loaded, and a reverse operation also takes place for unloading.

Other patents which disclose related devices are U.S. Pat. No. 2,919,168 to Shivek and U.S. Pat. No. 3,357,346 to Crafoord.

However, none of these patents is related to a garbage can for household use. Rather, the above patents disclose devices which include a spring-biased platform or similar mechanism in order to selectively dispose the platform and materials contained thereon in a desired position. Specifically, some of the above references utilize a spring-biased platform which is depressed within the container during loading, and which displaces upwardly during unloading so that the goods to be unloaded are always at a convenient height. Still other ones of the above references receive sliver or roving material from a textile manufacturing operation, where it is desirable to have the platform in an upwardly extended position to accept slivers and to cause the platform to depress as the sliver material is increased, enabling a full load to be accepted while support is always provided by the platform. The structures disclosed by the prior art, however, do not provide a convenient and efficient configuration for a household garbage can.

OBJECTS AND SUMMARY OF THE INVENTION

Accordingly, it is an object of the present invention to provide a self-ejecting garbage receptacle that overcomes the problems with the aforementioned prior art.

It is another object of the present invention to provide a self-ejecting garbage receptacle that provides for automatic and strain-free removal of refuse from the container.

It is still another object of the present invention to provide a self-ejecting garbage receptacle in which the garbage receptacle is used in a manner similar to a conventional garbage receptacle, but in which the garbage can be automatically raised to remove the garbage bag from the receptacle in a strain-free manner.

It is yet another object of the present invention to provide a self-ejecting garbage receptacle for household use.

It is still another object of the present invention to provide a self-ejecting garbage receptacle in which the garbage receptacle is used in a manner similar to a conventional garbage receptacle, but in which the garbage can be automatically raised out of the receptacle and brought safely to the floor in a strain-free manner.

It is yet another object of the present invention to provide a self-ejecting garbage receptacle in which the garbage receptacle is used in a manner similar to a conventional garbage receptacle, but in which the garbage can be automatically raised out of the receptacle and transferred safely and easily to a garbage bin in a strain-free manner.

In accordance with an aspect of the present invention, a self-ejecting garbage receptacle includes container means for holding a bag containing refuse, the container means having a bottom and a side wall enclosure with an open upper end, the side wall enclosure being connected with the bottom; belt means draped in the container means for normally supporting the bag in a lowered position in the container means, the belt means having first and second opposite ends, with the first end being fixed to the side wall enclosure adjacent the open upper end; and ejector handle means for raising the belt means, the ejector handle means being connected with the second opposite end of the belt means.

The ejector handle means has a substantially jug handle configuration, is pivotally connected at one end thereof to the container means and is connected with the second opposite end of the belt means at an opposite end thereof. A hinge is provided for pivotally connecting the one end of the ejector handle means to the container means. Further, the container means includes a hook, and the ejector handle means includes latch means for engaging with the hook to hold the belt means in a raised position.

In accordance with another aspect of the present invention, a self-ejecting garbage receptacle for household use, includes container means for holding a bag containing refuse, the container means having a bottom and a side wall enclosure with an open upper end, the side wall enclosure being connected with the bottom; tray means for holding a garbage bag thereon, the tray means being positioned in the container means in substantially parallel relation to the bottom and positioned thereabove; coil spring means connected between the tray means and the bottom for biasing the tray means upwardly away from the bottom; and latch means for releasably maintaining the tray means in a lowered position in normal use in which the coil spring means is compressed, wherein release of the latch means causes the coil spring means to raise the tray means, and thereby the garbage bag, to a raised position adjacent the open upper end for removal of the garbage bag from the container means.

Specifically, the coil spring means includes a plurality of parallel coil springs connected between the tray means and the bottom, and the latch means includes a rod slidably and removably positioned over the tray means to prevent upward movement of the tray means.

In accordance with still another embodiment of the present invention, a self-ejecting garbage receptacle for household use, includes container means for holding a bag containing refuse, the container means having a bottom and a side wall enclosure with an open upper end, the side wall enclosure being connected with the bottom; foldable tray means for holding a garbage bag thereon, the tray means being positioned in the container means in a folded configuration and assuming a substantially planar configuration when released from the container means; jack means positioned within the container means and connected to the tray means for moving the tray means upwardly away from the bottom and out of the container means and for returning the tray means in the folded configuration into the container means.

The jack means includes foot pedal means extending from the container means for controlling movement of the jack means.

In accordance with yet another embodiment of the present invention, a method of self-ejecting garbage from a container having a garbage bag support therein, includes the steps of maintaining the garbage bag support in a lowered position in the container while refuse is filled in a garbage bag positioned thereon; and biasing the garbage bag support to a raised position for removal of the refuse-filled garbage bag from the container.

In accordance with a further object of the present invention, a self-ejecting garbage receptacle for household use, includes a container; means for supporting a garbage bag in the container; means for maintaining the garbage bag support means in a lowered position in the container while refuse is filled in a garbage bag positioned thereon; and means for biasing the garbage bag support means to a raised position for removal of the refuse-filled garbage bag from the container.

In accordance with another aspect of the present invention, a self-ejecting garbage receptacle for household use, includes a container for holding a bag containing refuse, the container having a bottom and a side wall enclosure with an open upper end, the side wall enclosure including a front wall, a rear wall and side walls, the side wall enclosure being connected with the bottom, each of the side walls being connected between the front and rear walls, the rear wall being taller than the front wall; a tray member movable between a first lowered position within the container and a second raised position located proximal to the open upper end, the first lowered position being parallel relative to the bottom, the second raised position being angled relative to the bottom; a belt draped in the container having first and second opposite ends, with the first end being fixed to the front wall adjacent the open upper end, the belt being supportively coupled to the tray member; a retractor connected to the container for raising the belt and thus the tray, the retractor being shaped to receive the second end of the belt and a pivotable ramp, connected to the container proximal to the open upper end of the container.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
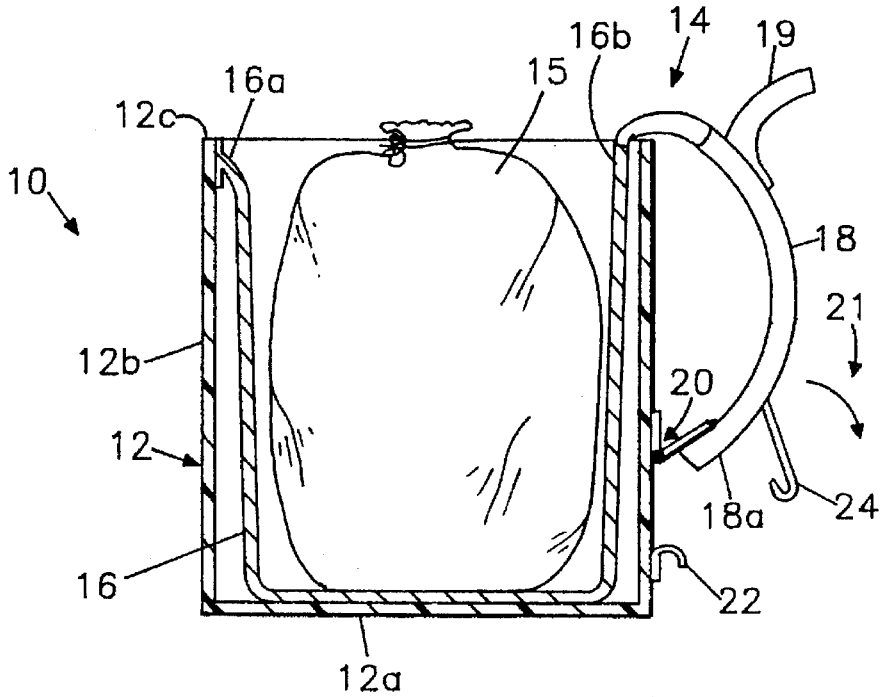
FIG. 1 is a longitudinal cross-sectional view of a self-ejecting garbage receptacle according to a first embodiment of the present invention, shown with the ejecting means in its lowered position.
Figure 2:
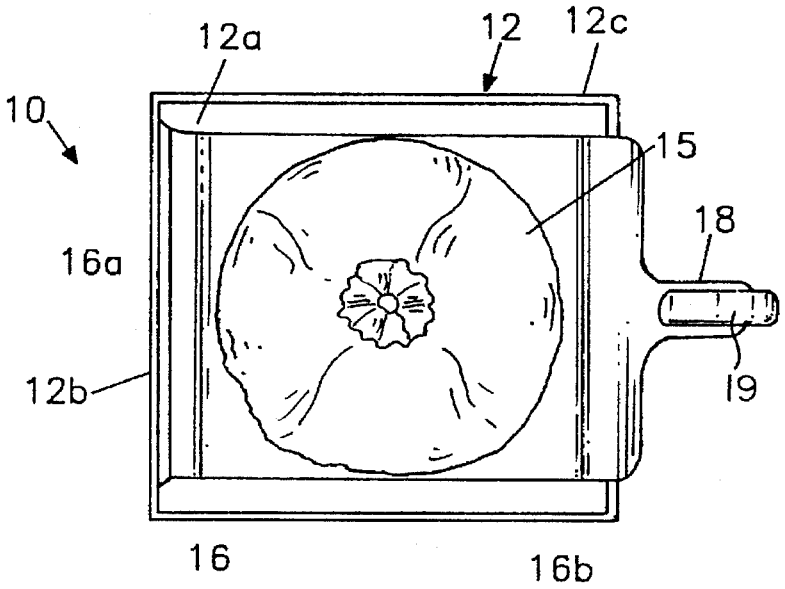
FIG. 2 is a top plan view of the self-ejecting garbage receptacle of FIG. 1.
Figure 3:
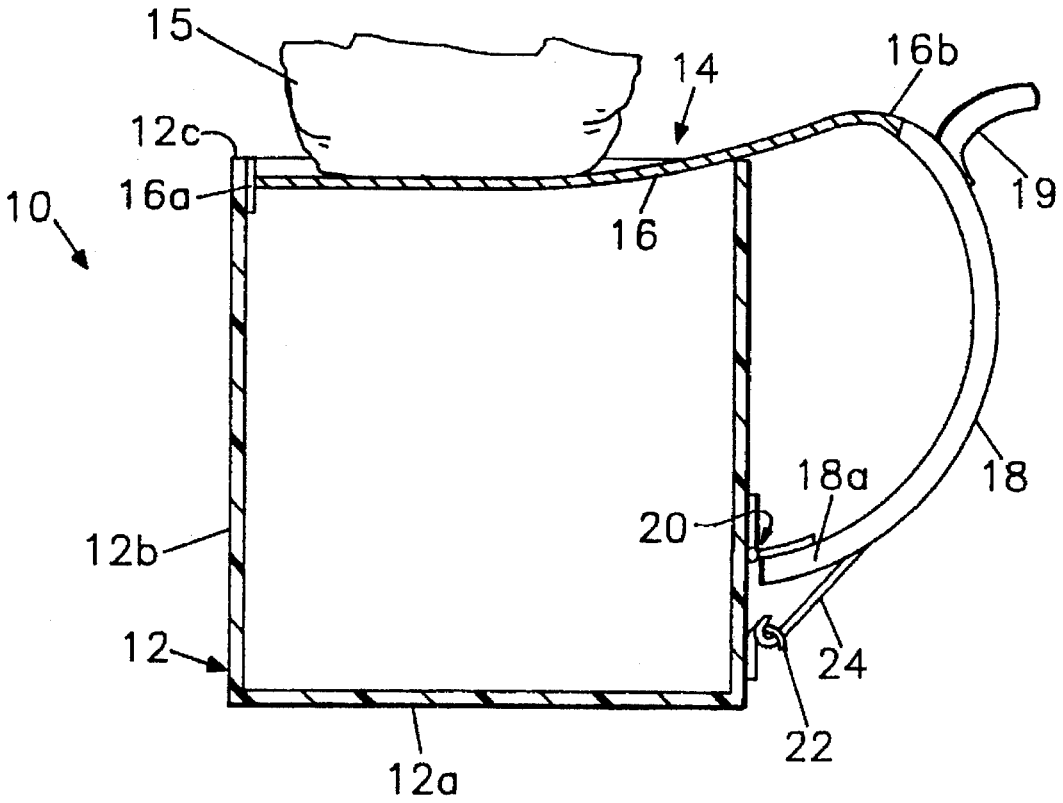
FIG. 3 is a longitudinal cross-sectional view of the self-ejecting garbage receptacle of FIG. 1, shown with the ejecting means in its raised position.

Referring to the drawings in detail, and initially to FIGS. 1–3 thereof, a self-ejecting garbage receptacle 10 according to the present invention includes a hollow container body 12. Preferably, container body 12 is made from a tough, relatively rigid plastic material. Container body 12 includes a bottom 12*a* and circumferential, upstanding side walls 12*b*. Further, container 12 is open at the upper end 12*c* thereof, that is, at the upper edges of side walls 12*b*.

Self-ejecting garbage receptacle 10 includes an ejecting mechanism 14 for ejecting a garbage bag 15 from container 12 to permit strain-free removal of the refuse from container 12. Ejecting mechanism 14 includes a web or belt 16 of generally similar width to container body 12 and having one end 16*a* secured to an upstanding side wall 12*b* adjacent upper end 12*c* by any suitable means, such as adhesive, clamps or the like. Belt 16 hangs down into container 12 with a U-shaped configuration, so as to cup or hold a garbage bag therein. The opposite end 16*b* of belt 16 is located adjacent upper end 12*c* at the opposite side of container 12, and is connected with an upright actuating lever 18 that is provided to raise up belt 16, and thereby raise up garbage bag 15.

Actuating lever 18 has a generally jug handle configuration, and may include a secondary handle element 19 protruding from the upper portion of actuating lever 18 (FIGS. 1 and 3). The lower end 18*a* of actuating lever 18 is pivotally connected to the external surface of a side wall 12*b* adjacent bottom 12*a*, by means of a hinge assembly 20 or similar pivoting mechanism. Specifically, lower end 18*a* of actuating lever 18 is pivotally connected to the side wall 12*b* that is opposite to end 16*a* of belt 16, that is, to the same side wall associated with end 16*b* of belt 16. The opposite, upper end 18*b* of upright actuating lever 18 is connected with opposite end 16*b* of belt 16.

Thus, by pivoting actuating lever 18 downwardly about hinge 20 in the direction of arrow 21, belt 16 attached thereto is forced upwardly, as shown in FIG. 3. Since garbage bag 15 is supported on belt 16, garbage bag 15 is moved upwardly with belt 16, and thereby ejected from container 12. Of course, it is preferred that garbage bag 15 be tied prior to such operation since it will no longer be constrained by side walls 12*b* of container.

Further, a latch 22 in the form of an eyelet or the like, can be provided on the lower end of ejecting mechanism 14 and a hook 24 can be provided on the external surface of one side wall 12*b* adjacent bottom 12*a* for engaging latch 22. In this manner, at the end of the pivoting action of ejecting mechanism 14, latch 22 can be engaged with hook 24 to maintain belt 16 and garbage bag 15 in the position shown in FIG. 3, so as to enable strain-free removal of garbage bag 15 from container 12.

Figure 4:
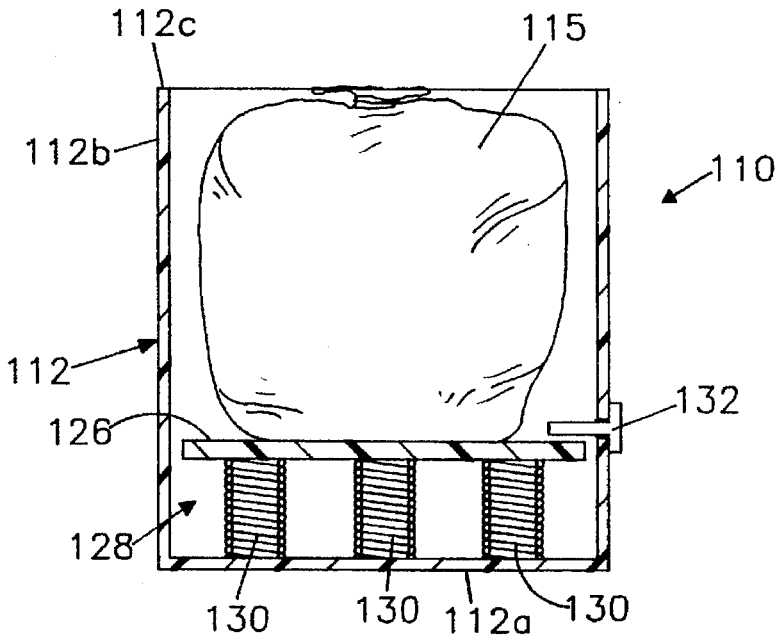
FIG. 4 is a longitudinal cross-sectional view of a self-ejecting garbage receptacle according to a second embodiment of the present invention, shown with the ejecting means in its lowered position.
Figure 5:
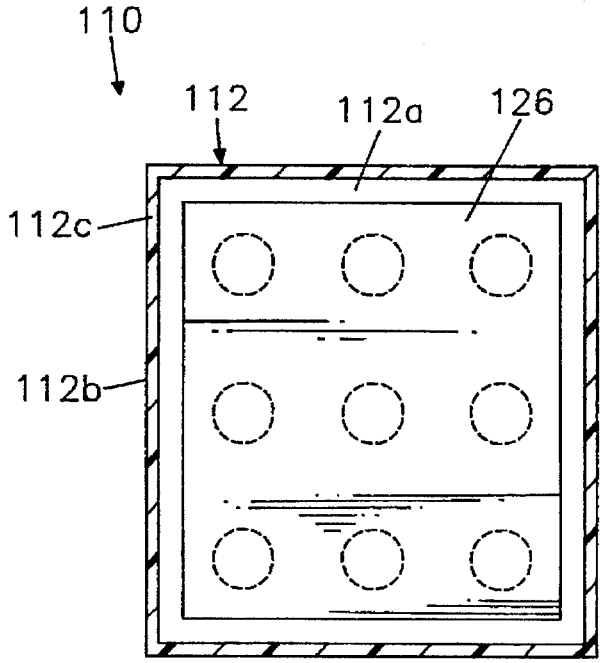
FIG. 5 is a top plan view of the self-ejecting garbage receptacle of FIG. 4.
Figure 6:
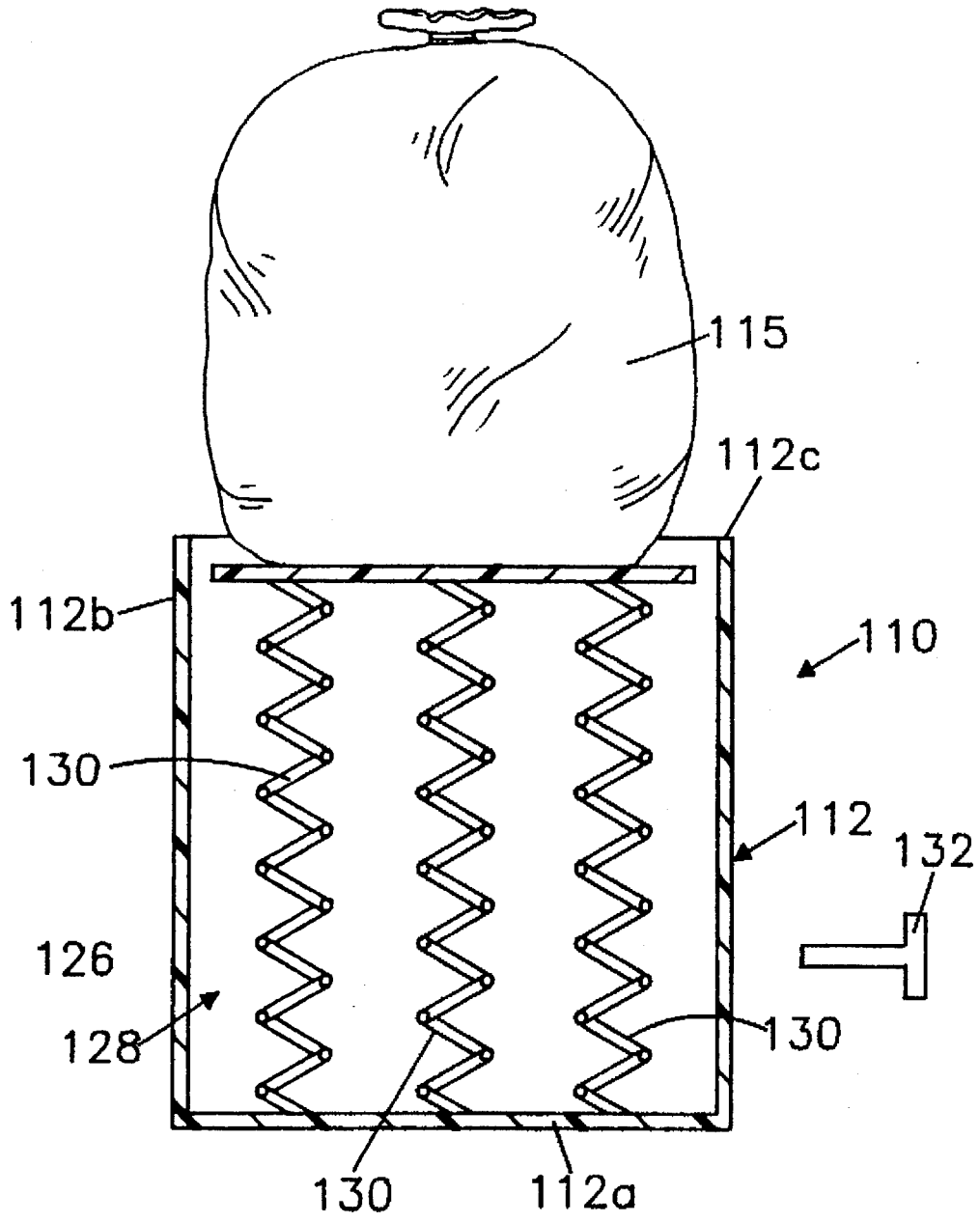
FIG. 6 is a longitudinal cross-sectional view of the self-ejecting garbage receptacle of FIG. 4, shown with the ejecting means in its raised position.

Referring now to FIGS. 4–6, a self-ejecting garbage receptacle 110 according to another embodiment of the invention will now be described in which elements corresponding to those in self-ejecting garbage receptacle 10 are identified by the same numerals, augmented by 100, and a detailed description of the common elements will be omitted herein for the sake of brevity.

In self-ejecting garbage receptacle 110, a planar tray 126 is connected to bottom 112*a* by means of a height adjusting mechanism 128. Specifically, height adjusting mechanism 128 is formed by a plurality of parallel coil springs 130 connected between bottom 112*a* and planar tray 126. Alternatively, a single large coil spring can be used. Normally, coil springs 130 are compressed and planar tray 126 is held in a lowered position by means of a latch 132 that is accessible from outside container 112 and which can be inserted through a hole 133 in container side wall 112*b*. In effect, latch 132 can be a pull rod or the like, as shown in FIG. 4, that can be pushed in to a restraining position above planar tray 126, so as to prevent upward movement of planar tray 126, or pulled out to permit coil springs 130 to bias planar tray 126 to a raised position. In this regard, coil springs 130 achieve a maximum height, as shown in FIG. 6, to bias planar tray 126 with a garbage bag 115 positioned thereon, to upper open end 112*c* of container 112.

In this regard, after a garbage bag 115 has been filled and tied, latch 132 is pulled out, whereupon coil springs 130 bias planar tray 126 to a raised position. Since garbage bag 115 is supported by planar tray 126, garbage bag 115 is also raised up to permit automatic, strain-free removal from container 112.

Although coil springs have been used as the ejecting mechanism in the second embodiment of the present invention, it will be appreciated that other types of springs can be used.

Figure 7:
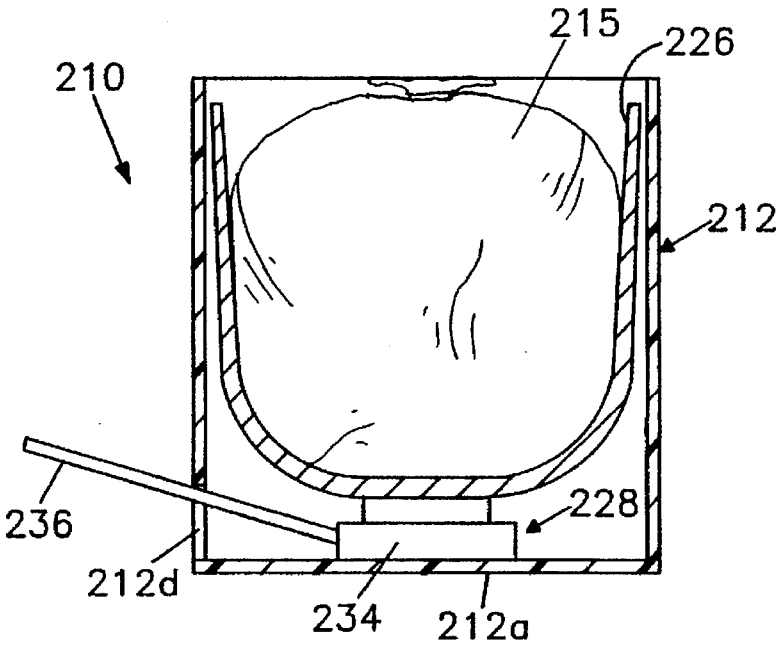
FIG. 7 is a longitudinal cross-sectional view of a self-ejecting garbage receptacle according to a third embodiment of the present invention, shown with the ejecting means in its lowered position.
Figure 8:
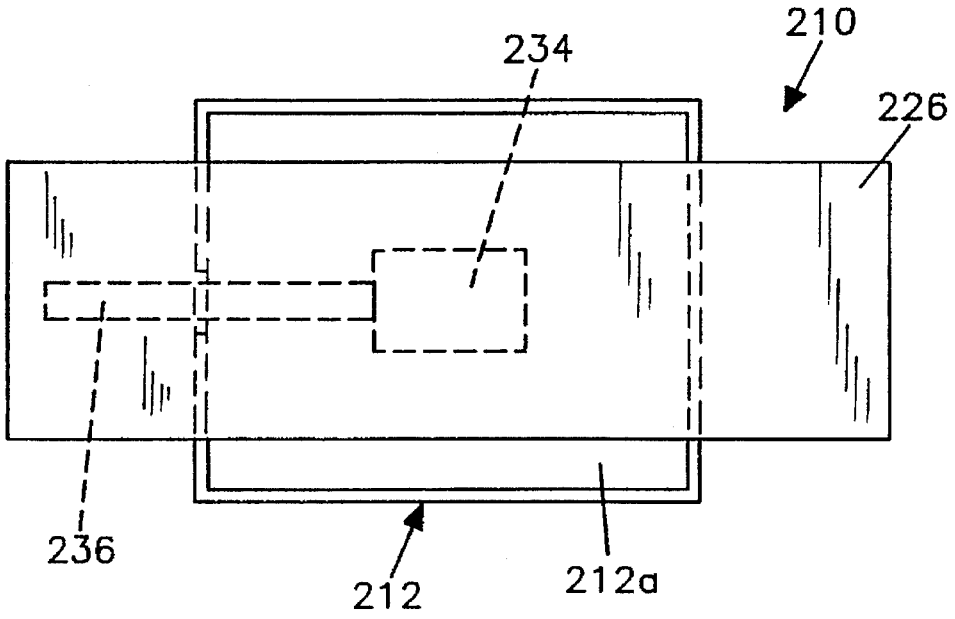
FIG. 8 is a top plan view of the self-ejecting garbage receptacle of FIG. 7.
Figure 9:
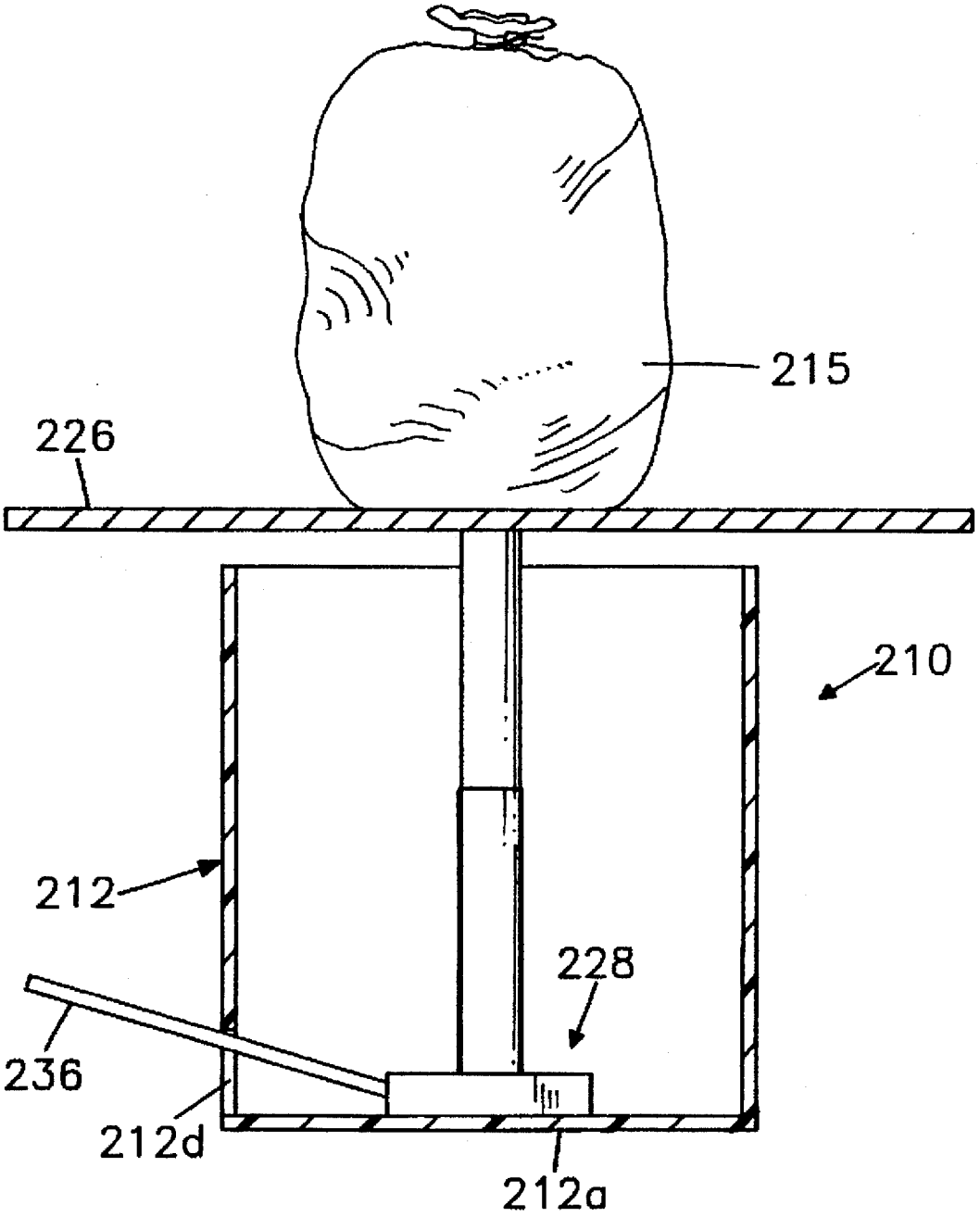
FIG. 9 is a longitudinal cross-sectional view of the self-ejecting garbage receptacle of FIG. 7, shown with the ejecting means in its raised position.

Referring now to FIGS. 7–9, a self-ejecting garbage receptacle 310 according to another embodiment of the invention will now be described in which elements corresponding to those in self-ejecting garbage receptacle 10 are identified by the same numerals, augmented by 200, and a detailed description of the common elements will be omitted herein for the sake of brevity.

Specifically, the height adjusting mechanism 228 of self-ejecting garbage receptacle 210 is formed by a jack 234 having an actuating foot lever 236 extending outwardly from container body 212 through an elongated vertical slot 212*d*. In this manner, by continuously pumping foot lever 236 up and down through vertical slot 212*d*, jack 234 can be raised. Jack 234 is only shown schematically and can include any conventional jacks. For example, a scissor jack or the like can be used along with a conversion mechanism which transforms the pumping action of foot lever 236 into a rotary action for raising the scissor jack. Alternatively, a pneumatic jack can be used which inflates the jack to raise the garbage bag 215.

A planar tray 226 is connected to the center of the jack portion that is raised. Planar tray 226 is normally in the open, planar configuration of FIG. 8. However, it can be folded into the substantially U-shaped configuration of FIG. 7 when jack 234 is positioned at the bottom 212*a* of container body 212. In such configuration, the folded planar tray 226 cradles the garbage bag 215, and when raised, it automatically unfolds into its natural state shown in FIGS. 8 and 9 to support garbage bag 215 thereon.

Further, although self-ejecting garbage receptacles 10, 110 and 210 are particularly useful for collecting and temporarily storing refuse and similar material, it will be appreciated that the present invention is not limited to the storage and removal of refuse for sanitary purposes, but can be used with the storage of other non-refuse type materials.

Figure 10:
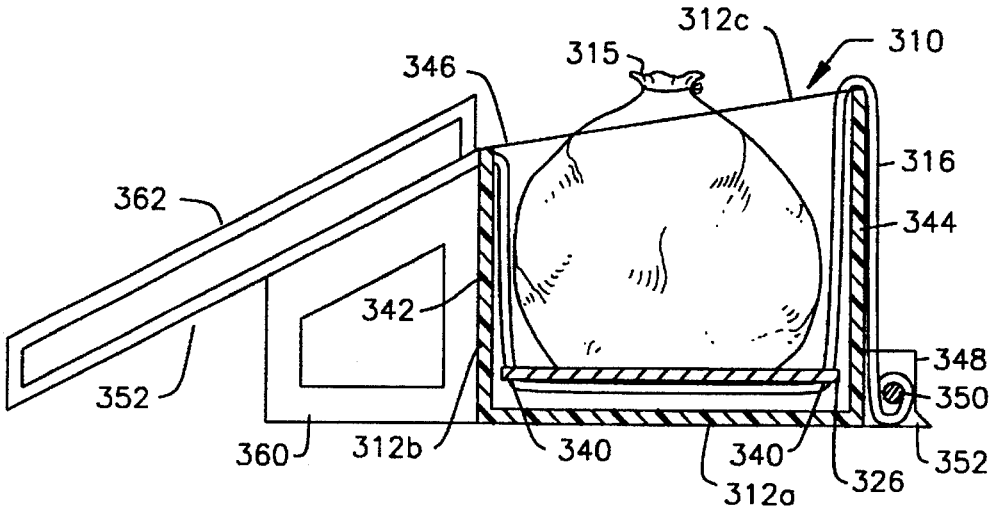
FIG. 10 is a longitudinal cross-sectional view of a self-ejecting garbage receptacle according to a fourth embodiment of the present invention, shown with the ejecting means in its lowered position.
Figure 11:
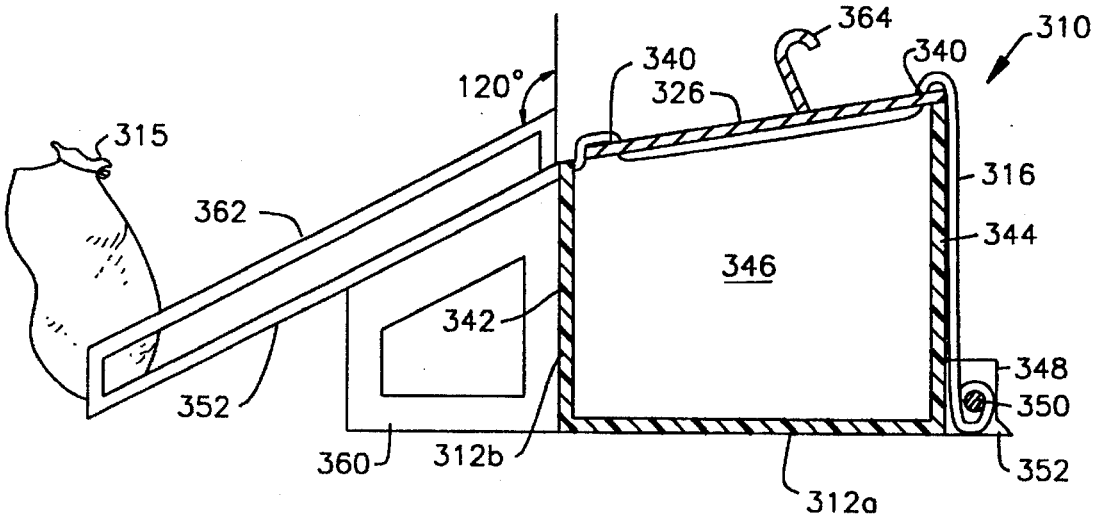
FIG. 11 is a longitudinal cross-sectional view of a self-ejecting garbage receptacle according to a fourth embodiment of the present invention, shown with the ejecting means in its raised position and shown with the garbage in its final position outside the receptacle.

Referring now to FIGS. 10 and 11, a self-ejecting garbage receptacle 310 according to another embodiment of the invention will now be described in which elements corresponding to those in self-ejecting garbage receptacle 10 and 110 are identified by the same numerals, augmented by 300 and 200 respectively, and a detailed description of the common elements will be omitted herein for the sake of brevity.

In self-ejecting garbage receptacle 310, circumferential, upstanding side walls 312*b* include a front wall 342, a rear wall 344 and side walls 346 all of which have different heights. In this embodiment the front wall 342 is the shortest, while the rear wall 344 is the tallest. The two side walls 346 vary in height such that at the point of connection with the front wall 342 they have the same height as the front wall 342 and at the point of connection with the rear wall 344 they have the same height as the rear wall 344. The planar tray 326 is connected to the belt 316 by inserting the belt 316 through slots 340 in planar tray 326. It will be obvious to one skilled in the art that the tray may be connected to the belt in a number of different ways.

Self-ejecting garbage receptacle 310 includes a retractor 348 for raising the belt 316 and thus the planar tray 326. The retractor 348 preferably has a motorized take-up reel 350 which is controlled by foot peddle 352. It will be obvious to one skilled in the art that while a motorized retractor is preferable it is possible for the retractor to be manual for instance as a crank. It will also be obvious that the foot peddle control can be a hand control or any number of different switches. The retractor 348 reels in the belt 316 until the belt 316 is taught which causes the planar tray 326 to rise until the planar tray 326 is even with the open upper end 312*c*, thus angled relative to the bottom 312*a*.

Self-ejecting garbage receptacle 310 further includes a ramp 352 having a top and two sides. The ramp is connected by a hinge (not shown) to the front wall 342 proximal to the open upper end 312*c*. The ramp 352 is connected so that the ramp 352 may be stored in closed position adjacent the front wall 342 or used in a position which is preferably at a 140 degree angle relative to the front wall 342. It will be obvious to one skilled in the art that closed position of the ramp 352 could be resting on top of the self-ejecting garbage receptacle thus being used as a cover for the self-ejecting garbage receptacle when the ramp is being stored in its closed position. When the planar tray 326 is even with the open upper end 312*c*, the garbage bag 315 may be slid down the ramp 352 onto the floor or possibly into a trash bin. To prevent the garbage bag 315 from falling off the side of the ramp 352, the ramp has railings 362 connected to the top of the ramp 352 proximal to the sides of the ramp 352. To help urge the garbage bag 315 off of the planar tray 326 and onto the ramp 352, a pivotable biasing lever 364 is connected within the planar tray 326. The pivotable biasing lever 364 is manually liftable from a first closed position wherein the biasing lever 364 lies flat within the planar tray 326 to a second open position wherein the biasing lever 364 is perpendicular to the planar tray 326. When the pivotable biasing lever 364 is moved from the first closed position to the second open position it urges the garbage bag 315 onto the ramp without the operator having to touch the garbage bag 315.

There is also a ramp support 360 vertically connected to the front wall 342 proximal to one of the side walls 346. The ramp support 360 is also connected by a hinge (also not shown) so that the ramp support 360 may be located adjacent the front wall 342 or possibly the side wall 346 when the ramp 352 is in a closed position or when the ramp 352 is being used to transfer the garbage bag into a bin or the like and the ramp 352 is resting on the bin. When the garbage bag 315 is to be slid to the floor, the ramp support 360 may be positioned under the ramp 352 so that the ramp 352 is supported at an angle of about 140° degrees relative to the front wall 342.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A self-ejecting garbage receptacle comprising:

a container for holding a bag containing refuse, said container having an open upper end, a bottom, a plurality of walls each being connected with said bottom, a first of said walls being taller than a second of said walls;

a tray member movable between a first lowered position within said container and a second raised position located proximal to said open upper end, said first lowered position being parallel relative to said bottom, said second raised position being angled relative to said bottom;

a belt draped in said container having first and second opposite ends, with said first end being fixed to one of said walls adjacent said open upper end, said belt being supportively coupled to said tray member;

a retractor coupled to said container for raising said belt and consequently raising said tray and said garbage bag, said retractor being shaped to receive said second end of said belt;

a pivotable ramp, having a top and two sides, coupled to said container proximal to said open upper end of said container.

2. A self-ejecting garbage receptacle according to claim 1, wherein said first of said walls comprises a rear of said container and said second of said walls comprises a front of said container.

3. A self-ejecting garbage receptacle according to claim 1, further including a pivotable biasing lever coupled within said tray member; said pivotable biasing lever being selectively moveable between a first closed position and a second open position.

4. A self-ejecting garbage receptacle according to claim 1, further including a tray return lever coupled to said tray member for returning said tray member from said raised position to said lowered position.

5. A self-ejecting garbage receptacle according to claim 1, further including two railings coupled to said top of said pivotable ramp proximal to said sides of said pivotable ramp.

6. A self-ejecting garbage receptacle according to claim 1, further including a ramp support member pivotally coupled to said front wall below said ramp.

7. A self-ejecting garbage receptacle according to claim 6 wherein said ramp support member supports said ramp at about 140° degrees relative to the front wall.

8. A self-ejecting garbage receptacle according to claim 1 further including a foot pedal coupled to said retractor for selectively engaging said retractor to reel in said belt.

9. A self-ejecting garbage receptacle according to claim 8 further including a release latch for disengaging said retractor.

* * * * *